US005546968A

United States Patent [19]

Jeon et al.

[11] Patent Number: 5,546,968

[45] Date of Patent: Aug. 20, 1996

[54] SUPPLEMENTARY WASHING DEVICE OF A DISH WASHER

[75] Inventors: Si M. Jeon; Seong K. Kang, both of Seoul, Rep. of Korea

[73] Assignee: Goldstar Co., Ltd., Seoul, Rep. of Korea

[21] Appl. No.: 325,873

[22] Filed: Oct. 19, 1994

[30] Foreign Application Priority Data

Oct. 23, 1993 [KR] Rep. of Korea ..... 22133/1993
Nov. 10, 1993 [KR] Rep. of Korea ..... 23818/1993

[51] Int. Cl.[6] ..... B08B 3/02

[52] U.S. Cl. ..... 134/179; 134/180; 134/183

[58] Field of Search ..... 134/179, 176, 134/180, 199, 183; 239/222, 222.19, 224

[56] References Cited

U.S. PATENT DOCUMENTS

| | | | |
|---|---|---|---|
| 603,580 | 5/1898 | Shaw | 134/183 |
| 1,511,661 | 10/1924 | Dantzebecher | 134/176 |
| 3,177,095 | 4/1965 | Gibson | 134/183 |
| 3,288,156 | 11/1966 | Jordan et al. | 134/183 |
| 3,809,106 | 5/1974 | Crabtree | 134/183 |
| 5,235,994 | 8/1993 | Comin et al. | 134/176 X |

FOREIGN PATENT DOCUMENTS

| | | | |
|---|---|---|---|
| 1454977 | 10/1966 | France | 134/176 |
| 1503866 | 6/1969 | Germany | 134/176 |
| 640240 | 7/1964 | Netherlands | 134/179 |

*Primary Examiner*—Frankie L. Stinson
*Attorney, Agent, or Firm*—Fish & Richardson P.C.

[57] ABSTRACT

This invention relates to a supplementary washing device of a dish washer, which has an additional spraying device that provides a uniform spray of washing water to a wider area. The supplementary washing device of the dish washer includes spray arms formed in the washer tub for spraying water onto dirty dishes and a circular supplementary arm rotated by the washing water flowing out through static pressure influencing means, and a splashing means formed on the circular supplementary arm. The spraying means is a plurality of spiralled blades fixed to the underside of the supplementary arm, becoming lower as they extend to the circumference, or a combination of blades having different lengths and different curvatures of spiral for rotating the supplementary.

5 Claims, 8 Drawing Sheets

SUPPLEMENTARY WASHING DEVICE OF A DISH WASHER

FIELD OF THE INVENTION

This invention relates to a supplementary washing device of a dish washer, more particularly to a supplementary washing device of a dish washer, which has an additional spraying device for uniform spray of washing water to a wider area provided in a feed water pipe feeding washing water to spray arms.

DESCRIPTION OF THE PRIOR ART

System, operation, and the problems of a prior dish washer are to be explained hereinafter, referring to FIGS. 1–5.

Shown in FIGS. 1 and 2 are a prior art dish washer.

A circulating pump 10 at lower part of a tub 1 feeds washing water to upper and lower spray arms 2 and 11. The feed washing water is sprayed through spray nozzles 8 in the upper and the lower spray arms 2 and 11 dropping dirt from dishes on upper and lower racks 12 and 13. The dropped dirt is filtered by a filter 14 at lower part of the tub 1. Washing water circulated by the circulating pump 10 is recirculated for a designated time to wash and rinse and then discharged when the washing is finished.

The upper spray arm 2 has spray nozzles 8 at upper and lower sides thereof, and the lower spray arm 11 has spray nozzles at the upper part thereof. Therefore, both sides of dishes 9 on the lower rack 13 can be washed cleaned. Feed water pipe 18 connected to the upper spray arm 2 has a feed water guide 3 at the end thereof. The feed water guide 3 has a supplementary arm 4*a* rotatably mounted thereon as a supplementary washing means, and the supplementary arm 4*a* has a plurality of spiral flow guides 5*a* having the same height relative to one another fixed at the underside thereof. The plurality of spiral flow guides 5*a* strike washing water sprayed from the spray nozzles 8 in the spray arm 2 to spray it to a wider area.

However, such spiral flow guides 5*a* formed on the supplementary arm 4*a* of the prior art dish washer has a limited spray area because the flow guides 5*a* have the same relative height to one another. Due to this, in case the area desired to spray is wider, the radius of the supplementary arm 4*a* should be made greater, but that makes the supplementary arm 4*a* liable to hit dishes 9.

Next, other prior art shown in FIGS. 3–5 is to be explained hereinafter.

Overall system of the prior art shown in FIGS. 3–5 is similar to the prior art shown in FIGS. 1 and 2. The prior art shown in FIGS. 3–5 is featured by which a feed water part 3' has a spray element 28 joined thereto. The spray element 28 has a first, a second, and a third annular projection pieces 28*a*, 28*b* and 28*c*. The first annular projection piece 28*a* has a plurality of spray nozzles 28*d*, and the second annular projection piece has a greater diameter than the spray nozzles 28*d* than the third annular projection piece 28*c*.

With the foregoing arrangement, washing water from the feed water part 3' is fed to the spray arm 2 through a hollow inside of the spray element 28. At the same time, washing water sprayed through the spray nozzles 28*d* formed at the circumference of top of the spray part 28 impinges onto the second annular projection piece 28*b* and the third annular projection piece 28*c* to splash around the circumference to wash the upper part of the dishes 9.

However, the prior art can not make a uniform spray of washing water to all of the dishes 9 on the upper rack. Further, the prior art has problems in that the pressure and quantity of washing water are reduced significantly due to the effluence of dynamic pressure of the washing water flowing through the feed water pipe 18.

SUMMARY OF THE INVENTION

The object of this invention is to provide a supplementary washing device or a dish washer, which can solve the foregoing problems.

These and other objects and features of this invention can be achieved by providing a supplementary washing device of a dish washer, including a tub forming an outer wall of a dish washer, spray arms formed in the tub for spraying washing water onto dirty dishes, a feed water pipe for feeding washing water to the spray arms at a fixed pressure, a static pressure effluence means formed in the feed water pipe for making washing water flow out of the feed water pipe by the static pressure of the washing water, a circular supplementary arm rotated by the washing water flowing out through the static pressure effluence means, and a splashing means formed on the circular supplementary arm for splashing washing water all over the dishes.

BRIEF DESCRIPTION OF THE INVENTION

DETAILED DESCRIPTION OF THE INVENTION

This invention is to be described in more detail hereinafter, referring to FIGS. 6–11 showing various embodiments of this invention. And, to prevent confusion of understanding in explaining the embodiments of this invention, for parts having the same system and service, the same reference numbers will be used.

Figure 1:
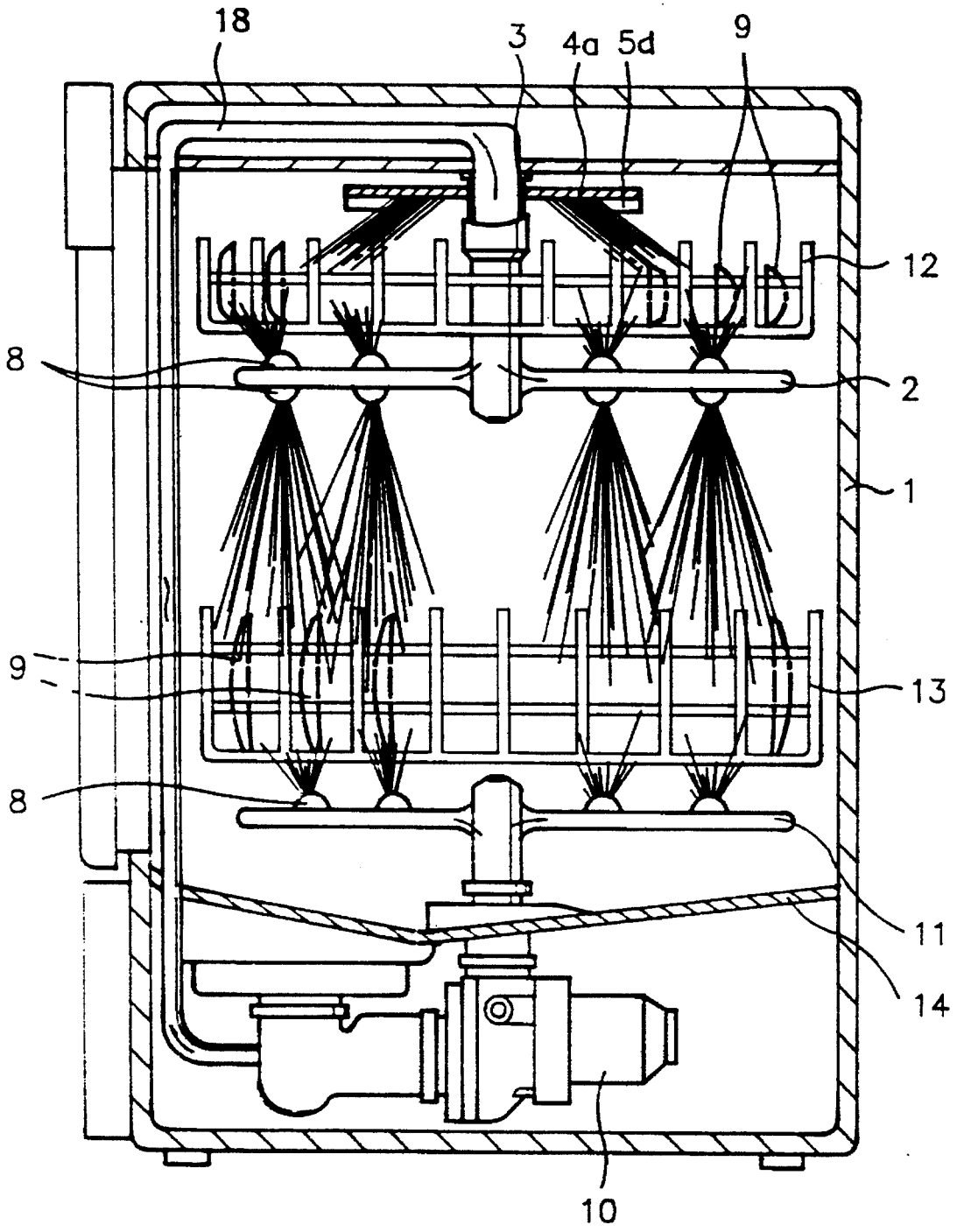
FIG. 1 PRIOR ART
FIG. 1 is a longitudinal section of a prior art dish washer.
Figure 2:
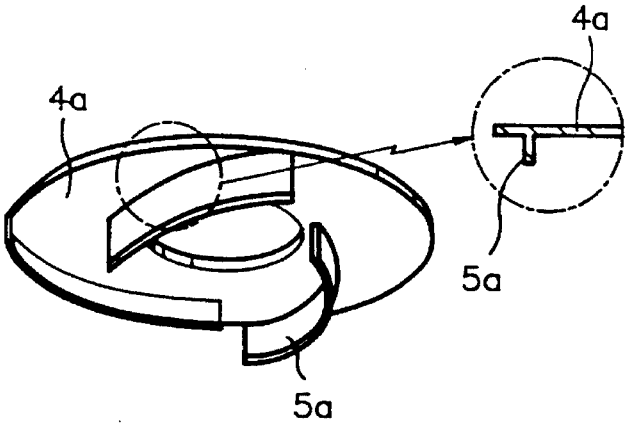
FIG.2 PRIOR ART
FIG. 2 is a perspective view of the supplementary arm of FIG. 1.
Figure 3:
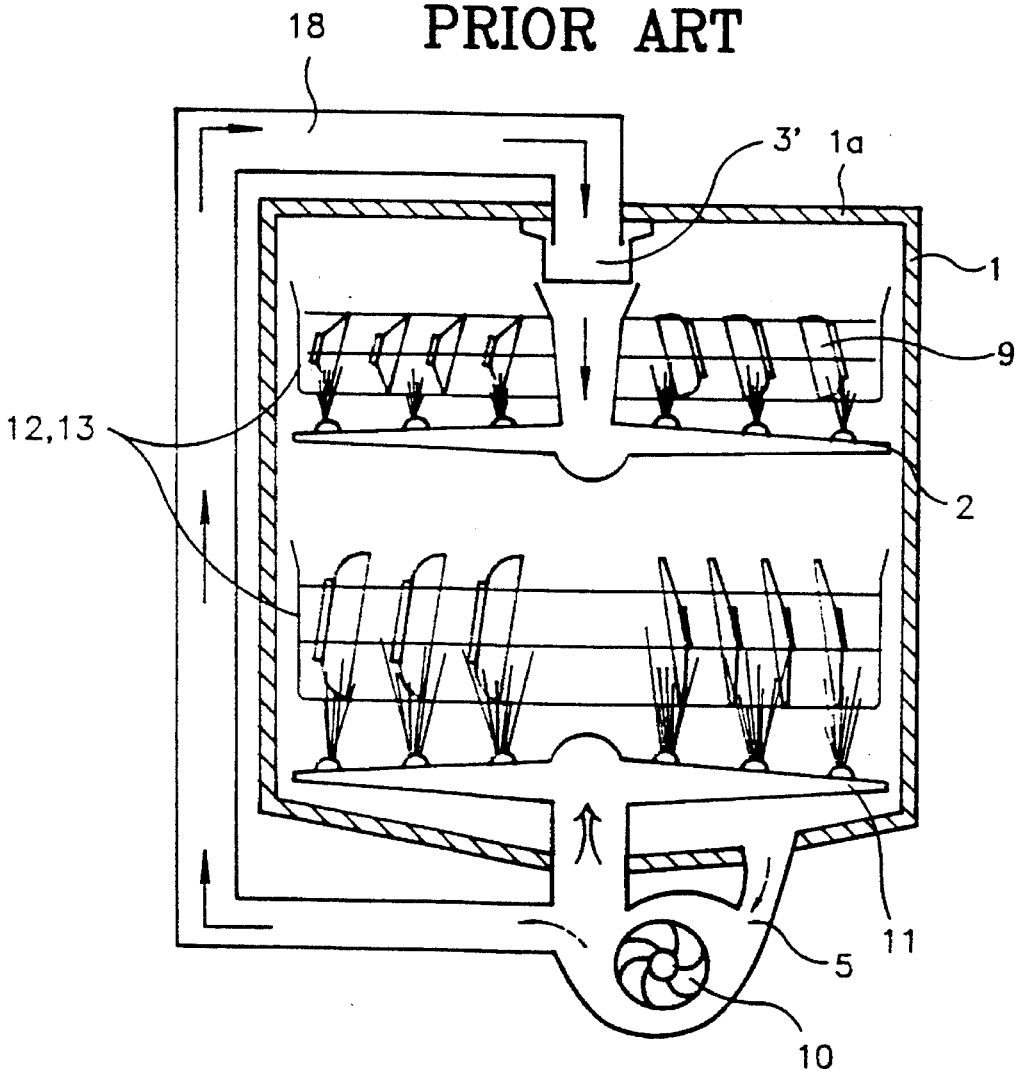
FIG.3 PRIOR ART
FIG. 3 is a longitudinal section of a other prior art dish washer.
Figure 4:
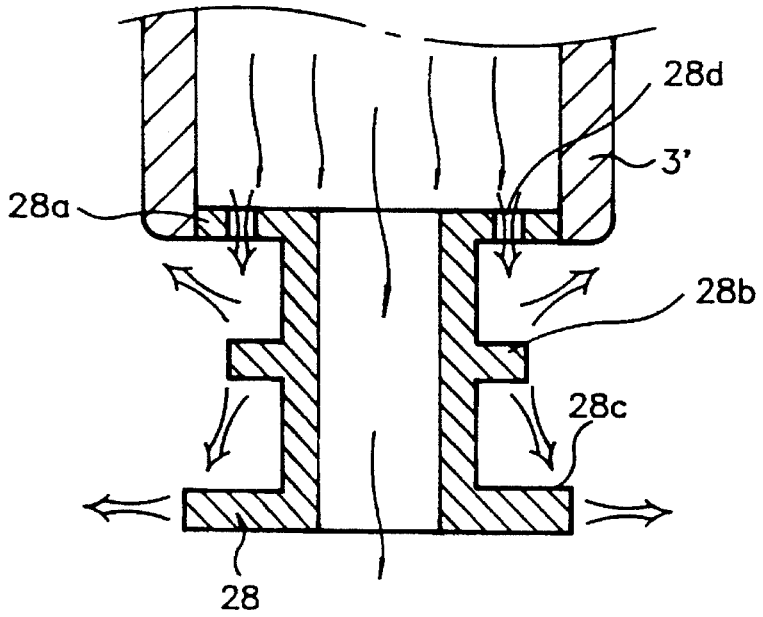
FIG.4 PRIOR ART
FIG. 4 is a longitudinal section of a spray element used in a dish washer of FIG. 3 for washing the upper part.
Figure 5:
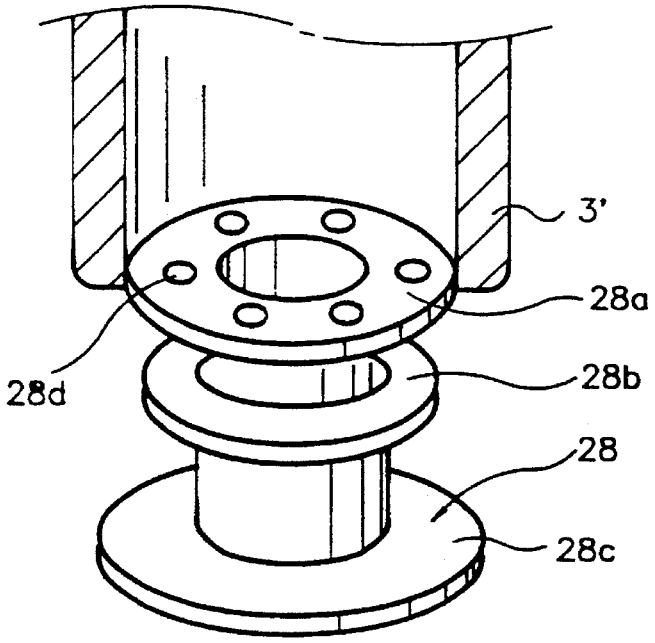
FIG.5 PRIOR ART
FIG. 5 is a perspective view of the spray element used in the dish washer of FIG. 3 for washing upper part.
Figure 6:
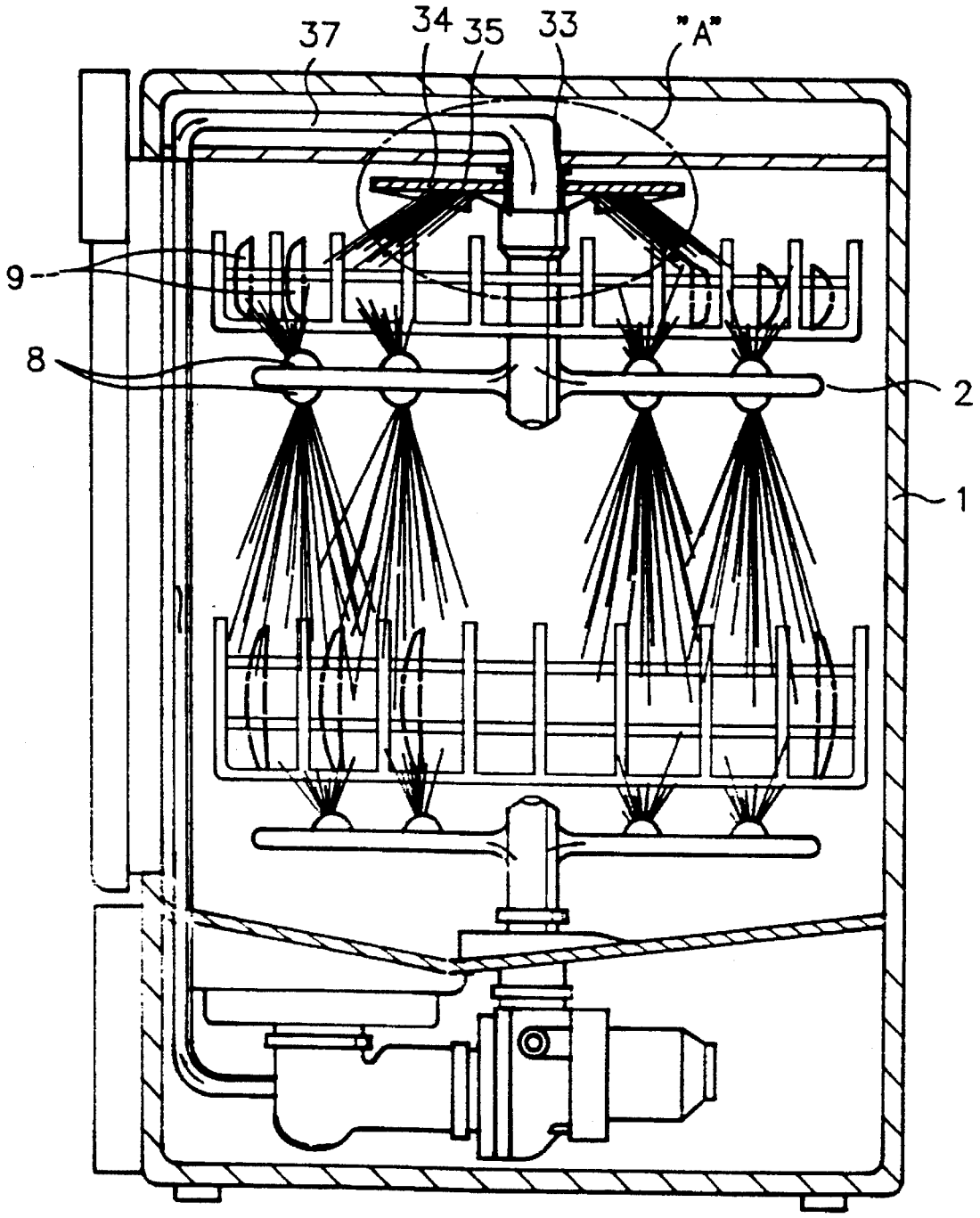
FIG. 6 is a longitudinal section of a supplementary washing device in a dish washer in accordance with this invention.
Figure 7:
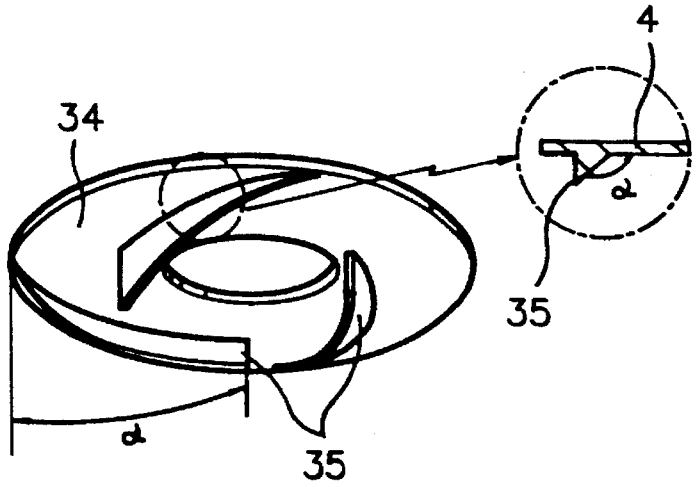
FIG. 7 is a perspective view of the supplementary arm of FIG. 6.
Figure 8:
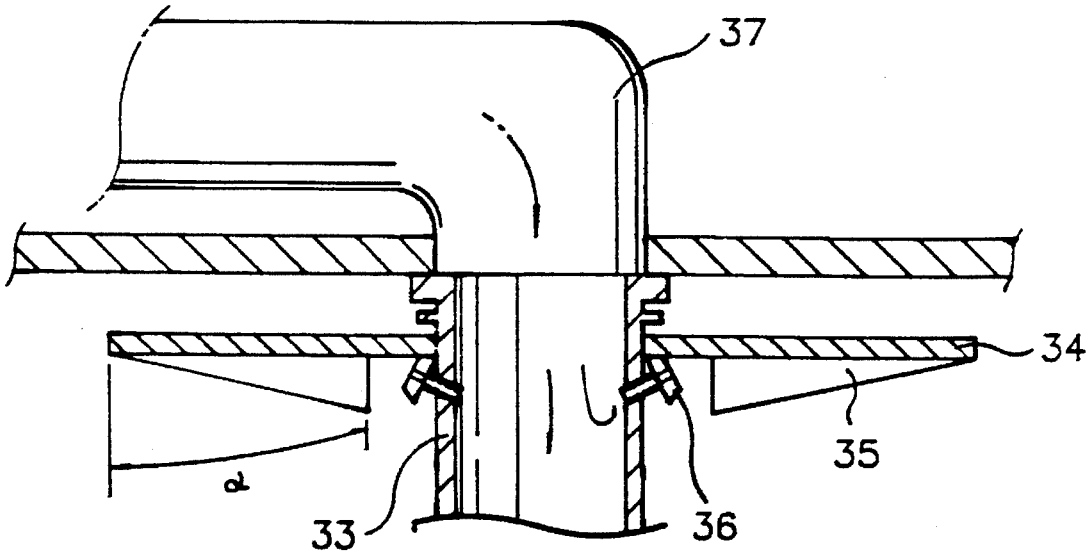
FIG. 8 is an enlarged view of part "A" of FIG. 6.

First, one embodiment of this invention shown in FIGS. 6–8 is to be explained hereinafter.

As shown in FIG. 6, a supplementary washing device of a dish washer in accordance with one embodiment of this invention includes a tub 1 forming outside wall of the dish washer, a upper spray arm 2 formed at upper part of the tub 1 for spraying washing water onto dirty dishes, a feed water pipe 37 for feeding washing water at a fixed pressure to the spray arm, a static pressure effluence means formed in the feed water pipe for making washing water flow out of the feed water pipe utilizing the static pressure of washing water, a circular supplementary arm 34 rotated by the washing water flown out of the static pressure effluence means, a spraying means formed at the circular supplementary arm for spraying washing water to all over the dishes by exerting different centrifugal forces to the washing water.

The static pressure effluence means is a plurality of hollow pins 33 each positioned penetrating the feed water pipe 37 or a feed water guide 33 with a slope to make contact with the rotating supplementary arm 33 to the minimum.

The spraying means is a plurality of blades 35 fixed to underside of the supplementary arm each spiralled from center to circumference of the supplementary arm and having a height becoming lower as it goes to the circumference, for rotating the supplementary arm with the pressure of the effluent washing water exerted thereon and spraying the washing water all over the dishes with centrifugal force.

Operation of the foregoing supplementary washing device of a dish washer in accordance with one embodiment of this invention is to be explained hereinafter, referring to FIGS. 7–8.

When washing water pressurized by the circulating pump flows into the feed water pipe 37 in the tub 1, the washing water is, passing through the feed water guide 33 connected to the feed water pipe 37, fed to the upper spray arm 2, and sprayed through the spray nozzles 8 provided at both sides thereof.

At the same time, the washing water is fed to the plurality of hollow pins 36 formed at the feed water guide 33 below the supplementary arm 34 sloped at a fixed angle to support the supplementary arm 34 with minimum contact surface at rotation of the supplementary arm 34 each having a hollow for passing the washing water. The washing water sprayed through the hollow pins by the static pressure of the washing water impinges on the plurality of spiral blades 5 fixed to the supplementary arm 34 to rotate the supplementary arm 34. The rotating supplementary arm and the plurality of blades 5 spray washing water to the dishes. Herein, since the height of the blade 35 becomes lower as it goes from the center to the circumference, i.e., angle of the slope $\alpha$ is formed greater than 90°, at rotation of the supplementary arm 34, the blades 35 can spray washing water to all mounted dishes 9. As the result, the washing effect on the dishes 9 can be improved significantly.

Figure 9:
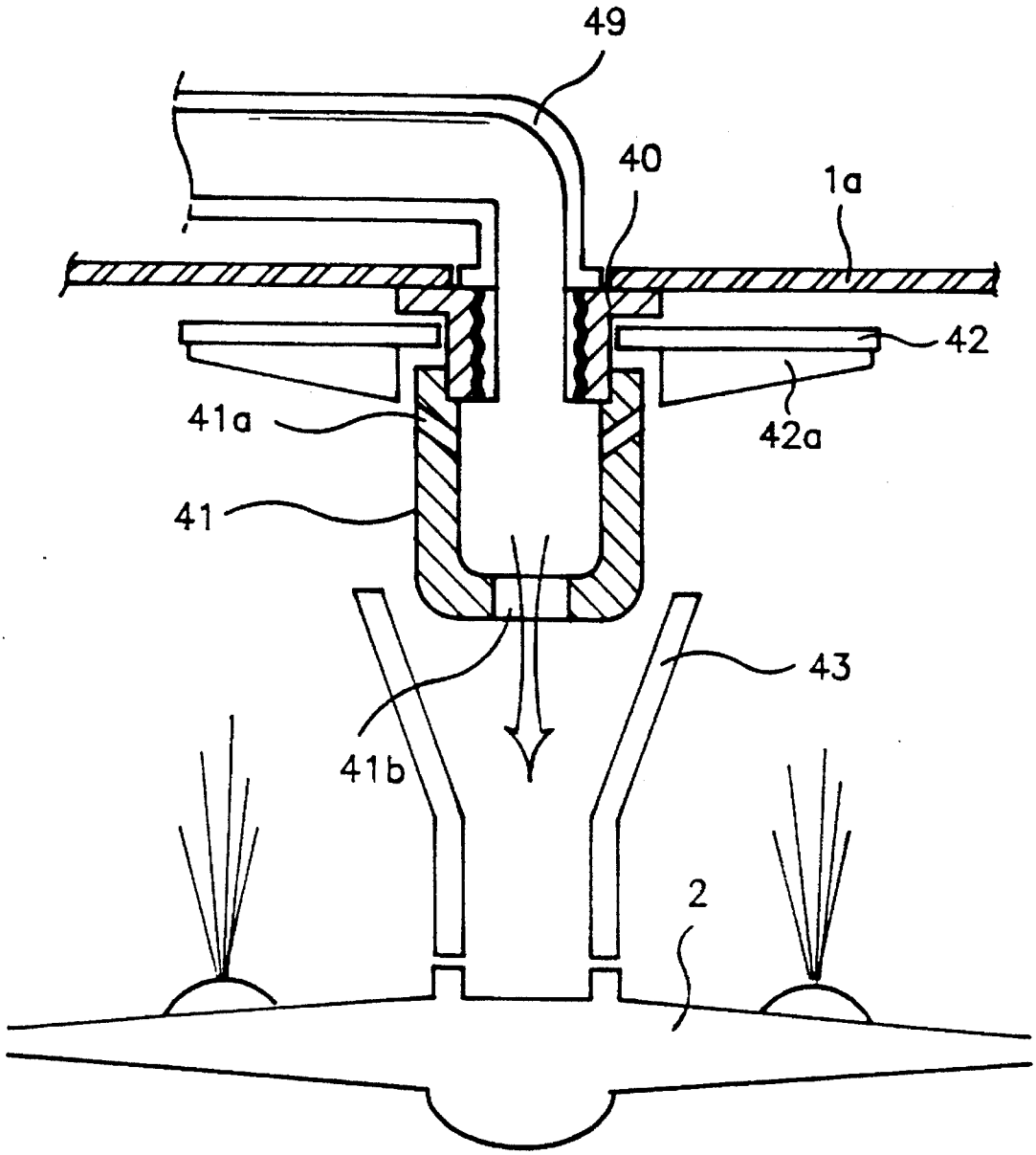
FIG. 9 is a longitudinal section showing another embodiment of this invention.
Figure 10:
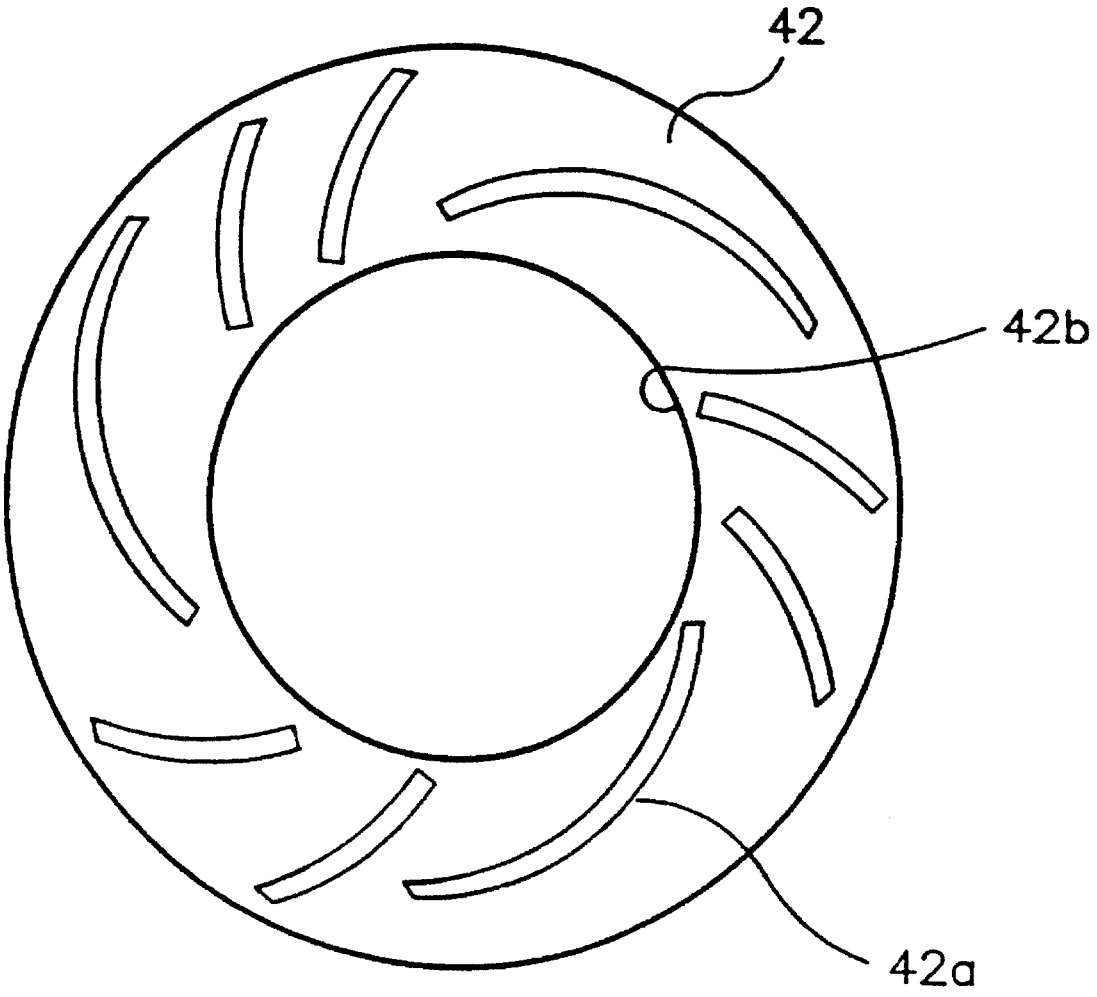
FIG. 10 is the supplementary arm of FIG. 9 seen from below.

Shown in FIGS. 9–10 is another embodiment of this invention. Overall system of the other embodiment of this invention shown in FIGS. 9–10 is similar to the embodiment of this invention shown in FIGS. 6–8 except for the static pressure effluence means and the washing water spraying means, which is to be explained hereinafter.

The static pressure effluence means includes intermediate connection pipes 40 and 41 formed between the feed water pipe 49 and the upper spray arm 2, and a plurality of spray holes 41*a* formed in the intermediate connection pipe for directing washing water to the circular supplementary arm 42. The intermediate connection pipe includes a connection pipe 40 threaded into the feed water pipe 49 having the circular supplementary arm 42 rotatably fixed thereon, and a pass through pipe 41 inserted into the connection pipe with a forced fit for passing washing water therethrough.

The spraying means is a combination of blades 42*a* spiralled from the center to the circumference of the supplementary arm 4, having different length and different curvature of spiral for rotating the supplementary arm with the pressure of effluent washing water exerted thereon and spraying washing water to all over the dishes with the centrifugal force.

Operation of the foregoing other embodiment of this invention is to be explained hereinafter, referring to FIGS. 9–10.

By feeding washing water flowing through the feed water pipe to the spray arm 2 through a passing through hole 41*b* of the passing through pipe 41 and the guide pipe 43, part of the washing water is sprayed upward at the same time through the sloped spray nozzles 41*a* by the static pressure of the washing water. The washing water sprayed by static pressure impinges on the blades 42*a* of the supplementary arm 42 to spray on all over the dishes 9. The combination of blades 42*a* of different length and curvature of spiral makes washing water spray far as well as near, thus preventing washing water from being sprayed locally.

Figure 11:
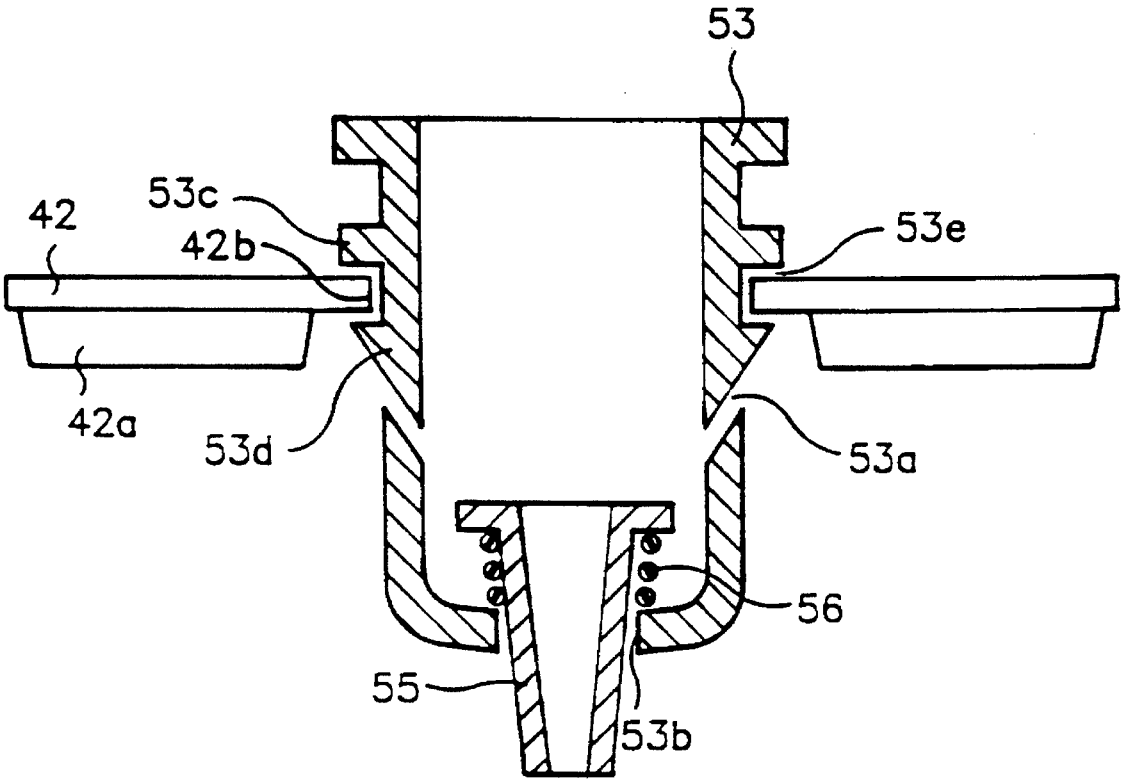
FIG. 11 is a longitudinal section showing another embodiment of this invention.

Shown in FIG. 11 is another embodiment of this invention. The overall system of another embodiment of this invention shown in FIG. 11 is similar to embodiments of this invention shown in FIGS. 6–10, except for the static pressure effluence means which is to be explained hereinafter.

The static pressure effluence means includes an intermediate connection pipe 53, upper and lower annular projections 53*c* and 53*d* formed on outside of the intermediate connection pipe 53 for inserting the supplementary arm 42 through a center hole 42*b* provided therein, a plurality of sloped spray holes 53*a* formed at the lower annular projection 53*d*, and a guide piece 55 mounted in the intermediate pipe 53 biased by a spring for guiding washing water to the upper spray arm 2.

Since operation of the foregoing another embodiment of this invention is similar to the one explained in FIGS. 9–10, the explanation is omitted.

As has been explained, the advantages of this invention are as follows.

Since the supplementary washing device of a dish washer in accordance with this invention includes spiral blades formed on the supplementary arm having either different height to one another or different length and curvature of spiral to one another, the supplementary washing device can have a wider spray area of the washing water and, accordingly, can improve efficiency of dish washing.

The supplementary washing device of a dish washer in accordance with this invention can make the static pressure of the washing water flowing through the feed water pipe 18 effluent to outside but has little effect on the pressure and quantity of the washing water. Therefore, the supplementary washing device allows a simultaneous washing of dishes through the spray arm and the supplementary washing device, and, accordingly, can improve the efficiency of dish washing.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A supplementary washing device of a dish washer comprising:

a tub forming an outer wall of a dish washer;

spray arms formed in the tub for spraying washing water onto dirty dishes;

a feed water pipe for feeding washing water to the spray arms at a fixed pressure;

a static pressure effluence means formed in the feed water pipe for making washing water flow out of the feed water pipe by the static pressure of washing water;

a circular supplementary arm rotated by the washing water flowing out through the static pressure effluence means; and a splashing means formed on the circular supplementary arm for splashing washing water all over the dishes by exerting different centrifugal forces to the washing water; and wherein the static pressure effluence means comprises a plurality of hollow pins penetrating the feed water pipe each positioned with a slope at a certain angle support and rotate the circular supplementary arm with a minimum contact area with the rotating circular supplementary arm.

2. The supplementary washing device of a dish washer as claimed in claim 1, wherein the spraying means is a plurality of blades fixed to underside of the supplementary arm each spiralled from the center to circumference of the supplementary arm and each having a blade height which becomes lower as the blade goes to circumference, for rotating the supplementary arm when the pressure of the washing water is exerted flowing out of the static pressure effluence means thereon and spraying the washing water all over the dishes with centrifugal force.

3. A supplementary washing device of a dish washer comprising:

a tub forming an outer wall of a dish washer;

spray arms formed in the tub for spraying washing water onto dirty dishes;

a feed water pipe for feeding washing water to the spray arms at a fixed pressure;

a static pressure effluence means formed in the feed water pipe for making washing water flow out of the feed water pipe by the static pressure of washing water;

a circular supplementary arm rotated by the washing water flowing out through the static pressure effluence means; and a splashing means formed on the circular supplementary arm for splashing washing water all over the dishes by exerting different centrifugal forces to the washing water; and wherein the static pressure effluence means includes intermediate connection pipes formed between the feed water pipe and the upper spray arm, and a plurality of spray holes formed in the intermediate connection pipe for directing washing water to the circular supplementary arm.

4. The supplementary washing device of a dish washer as claimed in claim 3, wherein the intermediate connection pipe includes a connection pipe threaded into the feed water pipe having the circular supplementary arm rotatably fixed thereon, and a pass through pipe inserted into the connection pipe within a forced fit for passing washing water therethrough.

5. The supplementary washing device of a dish washer as claimed in claim 3, wherein the spraying means is a combination of blades spiralled from the center to the circumference of the supplementary arm, each blade having a different length and different curvature of spiral for rotating the supplementary arm with the pressure of effluent washing water exerted thereon and spraying washing water to all over the dishes with the centrifugal force.

* * * * *